US008240173B2

(12) United States Patent
Lonati et al.

(10) Patent No.: US 8,240,173 B2
(45) Date of Patent: Aug. 14, 2012

(54) DEVICE FOR TAKEDOWN OF THE ARTICLE BEING FORMED, FOR CIRCULAR KNITTING MACHINES

(75) Inventors: Tiberio Lonati, Brescia (IT); Ettore Lonati, Botticino (IT); Fausto Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 13/376,647

(22) PCT Filed: Apr. 9, 2010

(86) PCT No.: PCT/EP2010/054731

§ 371 (c)(1),
(2), (4) Date: Dec. 7, 2011

(87) PCT Pub. No.: WO2010/142478

PCT Pub. Date: Dec. 16, 2010

(65) Prior Publication Data

US 2012/0073334 A1 Mar. 29, 2012

(30) Foreign Application Priority Data

Jun. 8, 2009 (IT) ..... MI2009A0995

(51) Int. Cl.
*D04B 15/88* (2006.01)

(52) U.S. Cl. ..... 66/153; 66/151

(58) Field of Classification Search ..... 66/149 R, 66/150, 151, 152, 153; 242/520, 534.2, 534, 242/539, 540, 541.6, 541.7
See application file for complete search history.

(56) References Cited

U.S. PATENT DOCUMENTS

| | | | | |
|---|---|---|---|---|
| 2,188,459 | A | 1/1940 | Kent et al. | |
| 2,710,530 | A | 6/1955 | Burdett | |
| 3,209,559 | A | 10/1965 | Sharp et al. | |
| 3,442,100 | A | 5/1969 | Manger et al. | |
| 4,671,083 | A * | 6/1987 | Sawazaki et al. | 66/151 |
| 4,879,886 | A * | 11/1989 | Okada et al. | 66/151 |
| 5,179,846 | A | 1/1993 | Lin | |
| 6,082,143 | A * | 7/2000 | Noonkester et al. | 66/151 |

FOREIGN PATENT DOCUMENTS

| | | |
|---|---|---|
| DE | 15 60 969 A1 | 9/1969 |
| GB | 2 246 369 A | 1/1992 |

OTHER PUBLICATIONS

International Search Report dated Jun. 2, 2010 issued in PCT/EP2O10/054731.

* cited by examiner

*Primary Examiner* — Danny Worrell
(74) *Attorney, Agent, or Firm* — Scully, Scott, Murphy & Presser, P.C.

(57) ABSTRACT

A device for takedown of the article being formed, for circular knitting machines, comprising at least one takedown roller, which is supported, so that it can rotate about its own axis, by a supporting structure and can engage, by means of its lateral surface, the article to be taken down. There are reloading means, which operate on a motor element to cause its rotation about a main axis in a second direction of rotation that is opposite to the first direction of rotation. The reloading means comprise a fluid-operated reloading cylinder, which is supported by the supporting structure and operates with the stem of its piston on the motor element with a reloading force that is oriented along a direction spaced from the main axis for applying to the motor element a reloading torque that is oriented concordantly with the second direction of rotation.

21 Claims, 9 Drawing Sheets

DEVICE FOR TAKEDOWN OF THE ARTICLE BEING FORMED, FOR CIRCULAR KNITTING MACHINES

TECHNICAL FIELD

The present invention relates to a device for takedown of the article being formed, for circular knitting machines.

BACKGROUND ART

As is known, knitted articles, during their production on machines, in particular on circular knitting machines, must be constantly subjected to adequate takedown in order to allow a correct and regular formation of the stitches.

In order to achieve this, adapted takedown devices are used which can be constituted by simple pneumatic suction devices, such as for example in circular machines of small diameter, or by more complex mechanical devices composed of one or more takedown rollers, on which the article is wrapped at least partially and which can generate greater takedown forces, for medium- and large-diameter circular machines.

Such takedown devices are essentially required to apply to the article being formed a substantially constant takedown force. This requirement can be met by way of two different operations, termed respectively "constant-torque operation" and "constant-speed operation". The more suitable operation type is selected according to the type of knitting to be produced. If there are no variations in the characteristics or structures of the knitting during the production cycle, "constant-speed operation" can be employed. If instead the production cycle provides for variations of the type or quantity of the knitting produced, such as for example in machines with electronic selection, with particular reference to those that transfer the knitting from needles to contiguous needles, the more suitable operation is constant-torque operation.

In constant-speed operation, a transmission ratio is set between the needle cylinder of the machine that produces the article and the takedown roller with which the article engages. In this manner, each variation of the rotation rate of the needle cylinder is matched by a variation of the rotation rate of the takedown roller. In order to achieve this result, reduction units and speed variators are used to transmit the rotary motion of the needle cylinder to the takedown roller. Alternatively, the takedown roller can also be driven by an independent electric motor that is driven with a rotation rate which is correlated to the rotation rate of the needle cylinder according to a preset ratio.

In constant-torque operation, the rotation of the takedown roller can undergo speed variations depending on the type of knitting being produced so as to keep the torque applied to the takedown roller and thus the takedown force applied to the article being formed substantially constant.

Takedown devices with constant-torque operation of the known type use, for driving the takedown roller, a torque limiter or a spring reloading system or an electric motor which can deliver a constant torque as the rotation rate varies.

Among devices with constant-torque operation, the takedown devices with spring reloading are, as a whole, the simplest devices to provide and manage. Such devices generally comprise at least one takedown roller, which is arranged with its axis in a horizontal position and is supported, so that it can rotate about its own axis, by a supporting structure arranged below the needle cylinder of the circular knitting machine. The takedown roller generally cooperates with other rollers so as to achieve the partial wrapping of the article on its lateral surface in order to have the adhesion to the article that is needed to actuate its takedown. Such devices are provided with a motor element, which can rotate with a reciprocating motion, along an arc of rotation, about a main axis, which generally coincides with the takedown roller axis. The motor element is connected to the takedown roller via a freewheel mechanism, which connects the motor element to the takedown roller only in one direction of rotation, whereas in the opposite direction of rotation it sets the motor element free with respect to the takedown roller. The motor element is connected to a spring that is connected to the supporting structure and whose function is to turn the motor element in the direction of rotation in which it is connected to the takedown roller. Moreover, the motor element is provided with an arm which engages portions of face cams, which are fixed to the supporting structure of the machine with respect to which the needle cylinder can be activated with a rotary motion around its vertically arranged axis.

In practice, in these devices, during the production of the knitted to article, the needle cylinder rotates about its own axis with respect to the supporting structure. The supporting structure of the takedown device rotates together with the needle cylinder and therefore the arm of the motor element engages progressively the portions of the face cams that generate the rotation of the motor element about the main axis in the direction of rotation in which the motor element rotates freely with respect to the takedown roller. This rotation, which has no effect on the takedown roller, produces however the loading of the spring, which, when the engagement of the motor element arm with the face cam portions ends, causes the rotation of the motor element about the main axis in the opposite direction, i.e., in the direction of rotation in which the motor element is rotationally connected to the takedown roller. The torque produced by the spring is thus transmitted to the takedown roller, which therefore applies a corresponding takedown force to the article that is engaged with it. By adequately positioning the spring and providing a large number of alternating rotations of the motor element, of reduced extent, at each turn of the needle cylinder about its own axis, it is possible to have a substantially constant torque that is produced by the spring and transmitted to the takedown roller.

The presence of a number of portions of face cams, which are necessary to have an adequate number of alternating rotations of the motor element, constitutes a structural complication of the machine and therefore one tends to limit as much as possible the number of said face cam portions, with the consequence, however, of having intolerable variations of the torque and therefore of the takedown force.

Moreover, in these devices there is no possibility of varying the extent of the rotation of the takedown roller as the quantity of knitting produced by the machine varies. In practice, these devices are designed as a function of the maximum theoretical quantity that can be produced by the machine and therefore do not allow to achieve high quality in the production of the articles.

DISCLOSURE OF THE INVENTION

The aim of the present invention is to provide a device for takedown of the article being formed, for circular knitting machines, that is simple in structure, can have a reduced weight even if it is designed to be mounted on medium- or large-diameter machines and is highly reliable in operation.

Within this aim, an object of the invention is to provide a device that makes it possible to vary, in a simple manner, the takedown force applied to the article being formed as a function of the amount of knitting actually produced and therefore allows the provision of articles that are qualitatively superior to those obtainable with takedown devices with spring reloading of the known type.

Another object of the invention is to provide a device whose installation is extremely easy and quick.

Another object of the invention is to provide a device in which it is also possible to adjust, with high precision, the extent of the takedown force applied to the article.

Another object of the invention is to propose a device that can be manufactured at competitive costs.

This aim and these and other objects that will become better apparent hereinafter are achieved by a device for takedown of the article being formed, for circular knitting machines, comprising:

- at least one takedown roller, which is supported so that it can rotate about its own axis by a supporting structure and can engage, by means of its lateral surface, the article to be taken down;
- a motor element that can rotate with a reciprocating motion, along an arc of rotation, about a main axis;
- actuation means, which operate on said motor element for its rotation about said main axis in a first direction of rotation;
- reloading means that operate on said motor element for its rotation about said main axis in a second direction of rotation that is opposite to said first direction of rotation;
- unidirectional connection means interposed between said motor element and said takedown roller for connecting said takedown roller to said motor element in its rotation in said first direction of rotation and for disconnecting said takedown roller from said motor element in its rotation in said second direction of rotation;

characterized in that said reloading means comprise a fluid-operated reloading cylinder, which is supported by said supporting structure and operates with the stem of its piston on said motor element with a reloading force that is oriented along a direction spaced from said main axis for applying to said motor element a reloading torque that is oriented concordantly with said second direction of rotation.

BRIEF DESCRIPTION OF THE DRAWINGS

Further characteristics and advantages of the invention will become better apparent from the description of a preferred but not exclusive embodiment, of the device according to the invention, illustrated by way of non-limiting example in the accompanying drawings, wherein.

WAYS OF CARRYING OUT THE INVENTION

Figure 1:
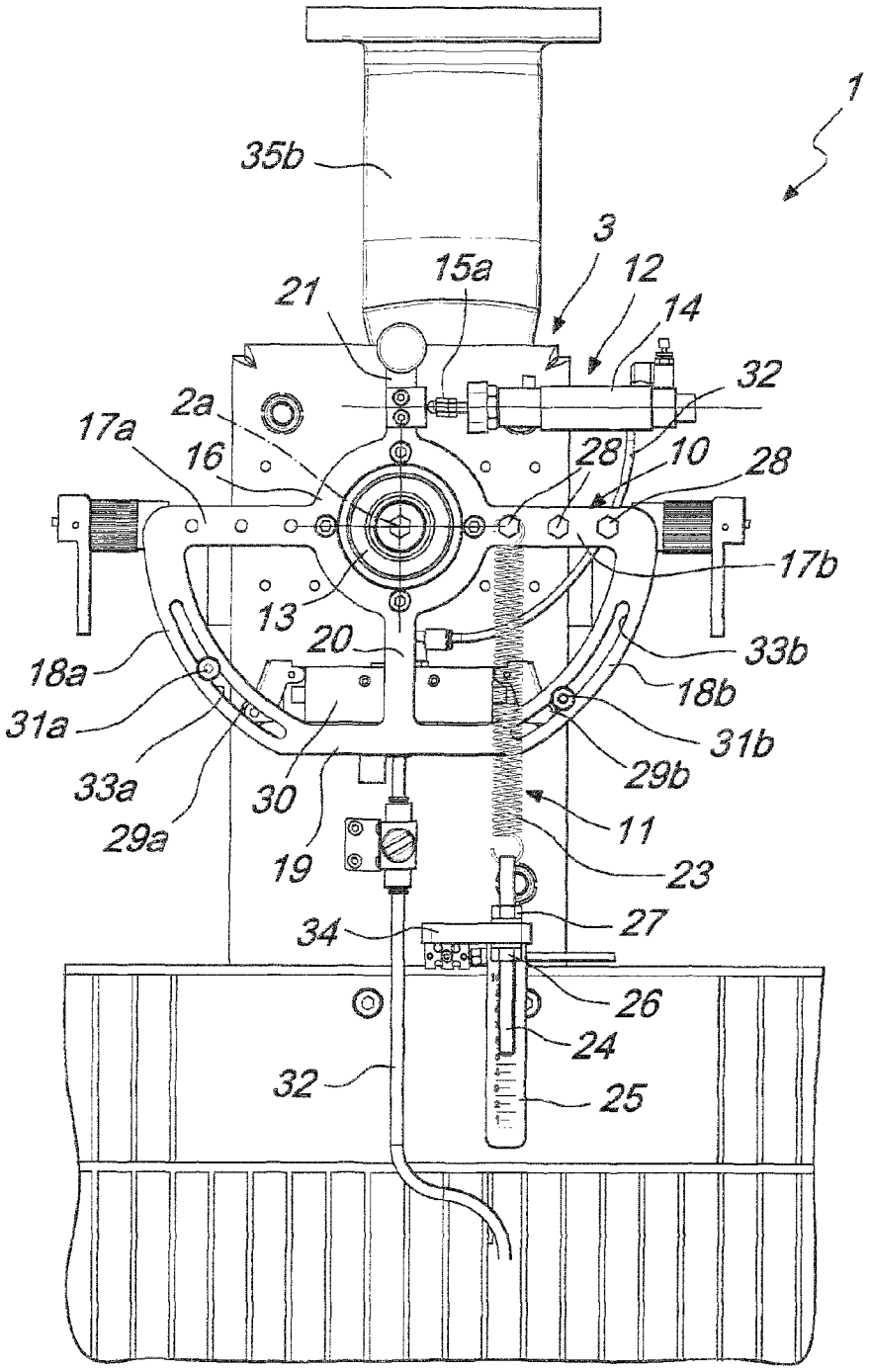
FIG. 1 is a front elevation view of the device according to the invention.
Figure 2:
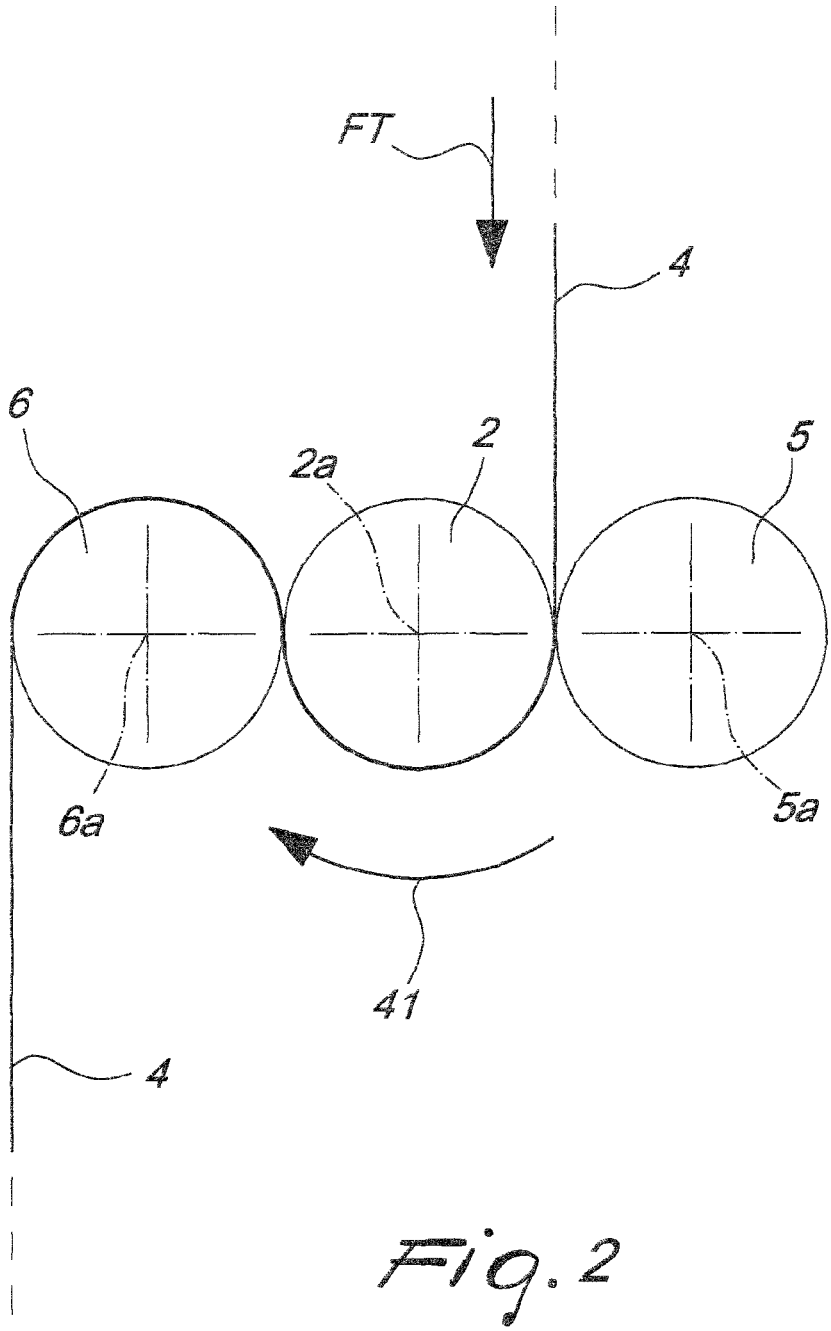
FIG. 2 is a schematic view of the engagement of the takedown roller with the article being formed.
Figure 3:
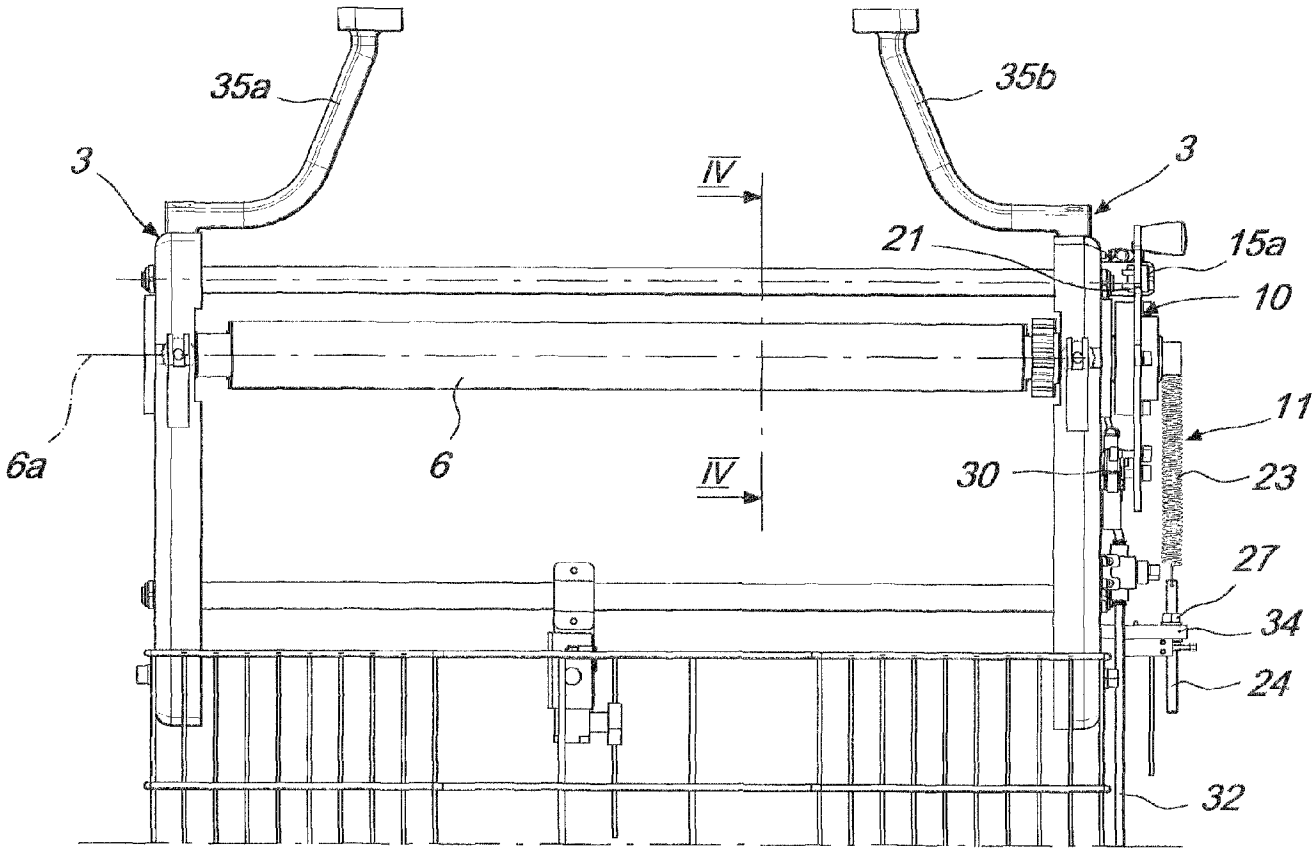
FIG. 3 is a side elevation view of the device according to the invention.
Figure 4:
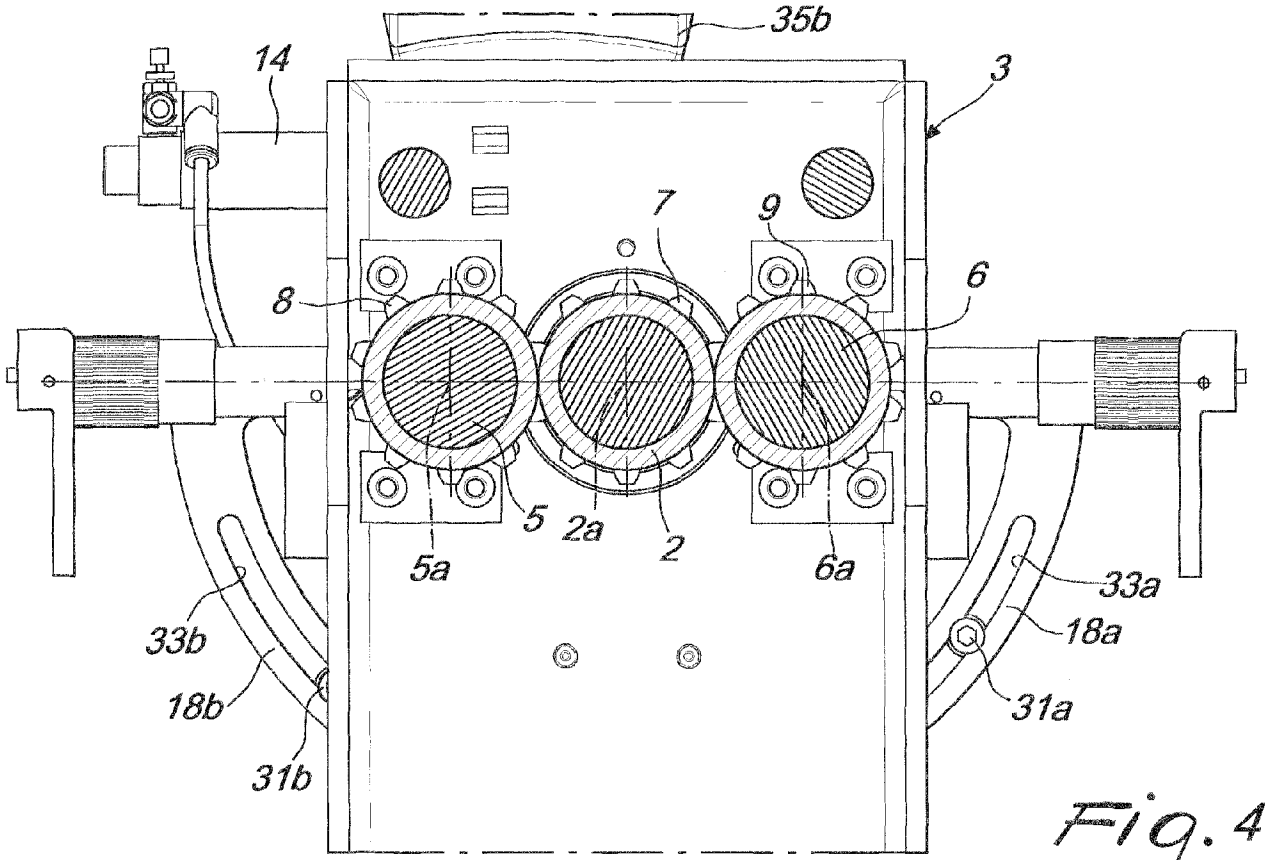
FIG. 4 is an enlarged-scale sectional view of FIG. 3, taken along the line IV-IV.

With reference to the figures, the device according to the invention, generally designated by the reference numeral 1, comprises at least one takedown roller 2, which is supported, so that it can rotate about its own axis 2*a*, by a supporting structure 3 and can engage, by means of its lateral surface, the article 4 to be taken down.

More particularly, the takedown roller 2 is arranged so that its axis 2*a* is horizontal and preferably cooperates with two other rollers 5, 6, which are supported by the supporting structure 3 so that they can rotate about their respective axes 5*a*, 6*a*, which are parallel to the axis 2*a* of the roller 2. The rollers 5 and 6 have the task of increasing contact between the article 4 and the takedown roller 2 and of partially wrapping the article 4 around the takedown roller 2 and thus divert the article 4, after it has left the takedown roller 2, toward a collecting basket or a wrapping roller, which are not shown or are shown only partially for the sake of simplicity. The rollers 2, 5, 6 are designed to be supported by the supporting structure 3 below the needle cylinder of a circular knitting machine, of a known type and not shown for the sake of simplicity, so as to engage the article 4 while it is being produced, in a manner known per se, by the needles of the knitting machine. The rollers 2, 5, 6 are conveniently mutually connected in rotation about their respective axes by means of a coupling based on gears 7, 8, 9 so that the takedown roller 2, located between the rollers 5 and 6, has a direction of rotation, about its own axis 2*a*, which is opposite to the direction of rotation of the rollers 5, 6.

The device according to the invention comprises a motor element 10 that can rotate with a reciprocating motion about a main axis of rotation along an arc of rotation. Preferably, the main axis of rotation coincides with the axis 2*a* of the takedown roller 2.

Moreover, the device according to the invention comprises actuation means 11 that operate on the motor element 10 to turn it about the main axis 2*a* in a first direction of rotation 41 and reloading means 12 that operate on the motor element 10 to cause its rotation about the main axis 2*a* in a second direction of rotation 42 that is opposite to the first direction of rotation 41.

Unidirectional connection means 13 are interposed between the motor element 10 and the takedown roller 2 for connecting the takedown roller 2 to the motor element 10 in its rotation in the first direction of rotation 41 and disconnecting the takedown roller 2 from the motor element 10 in its rotation in the second direction of rotation 42.

According to the invention, the reloading means 12 comprise a fluid operated reloading cylinder 14, which is supported by the supporting structure 3 and operates with the stem 15*a* of its piston 15 on the motor element 10 with a reloading force FR that is oriented along a direction spaced from the main axis 2*a* for applying to the motor element 10 a reloading torque CR that is oriented concordantly with the second direction of rotation 42.

More particularly, the motor element 10 comprises an annular body 16 that is arranged with its axis at the main axis 2*a* and two arms 17*a*, 17*b* that extend radially outward from two diametrically opposite regions of the annular body 16. The ends of the arms 17*a*, 17*b* that are opposite with respect to the annular body 16, are mutually connected by curved portions 18*a*, 18*b* and by a substantially straight central portion 19 that in turn is connected, in an intermediate region of its extension, to the annular body 16 by means of a spoke 20.

The arms 17*a*, 17*b* and the spoke 20 constitute, in practice, three spokes of a half-wheel and, on the side opposite to the spoke 20, a further arm or spoke 21 extends on which the stem 15*a* of the piston 15 of the fluid-operated reloading cylinder 14, which is preferably constituted by a pneumatic cylinder, operates.

The unidirectional connection means 13 are preferably constituted by a freewheel mechanism that is interposed between the annular body 16 of the motor element 10 and the shaft 22 of the takedown roller 2.

Conveniently, the device according to the invention also comprises means 45 for unidirectional rotation of the takedown roller 2, which allow the takedown roller 2 to rotate freely about its own axis 2*a* in the direction of rotation that takes down the article 4, but prevent it from rotating in the opposite direction.

Figure 5:
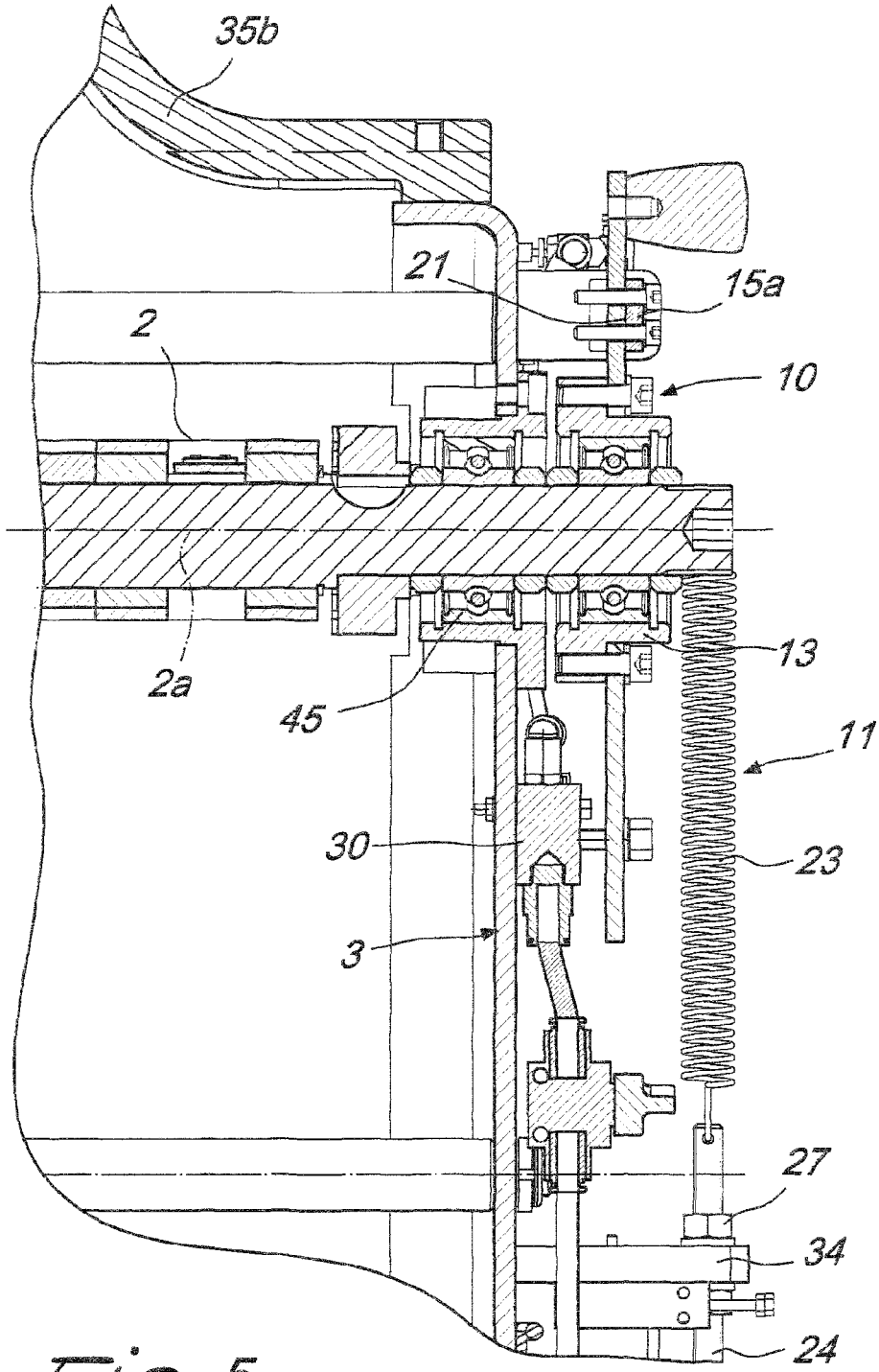
FIG. 5 is an enlarged-scale sectional view of a detail of FIG. 3, taken along a vertical plane that passes through the takedown roller axis.

The unidirectional rotation means 45 are constituted by another freewheel mechanism, shown in FIG. 5, which is interposed between the takedown roller 2 and the supporting structure 3.

In practice, in the embodiment shown, the unidirectional rotation means 45 prevent the takedown roller 2 from being able to rotate in the second direction of rotation 42, by means of the takedown applied to the article 4, during the actuation of the fluid-operated reloading cylinder 14, as will become better apparent hereinafter.

The actuation means 11, in the illustrated embodiment, comprise elastic means that contrast the rotation of the motor element 10 which is actuated by the reloading means 12. Such elastic means are preferably constituted by a helical spring 23 that is connected by means of one of its ends to the motor element 10 and by means of its opposite end to the supporting structure 3. The helical spring 23 is arranged along a direction that is spaced from the main axis 2*a* so that the driving force FM, which is generated by the elastic reaction of the helical spring 23, produces on the motor element 10 a driving torque CM that is oriented concordantly with the first direction of rotation 41, i.e., in the direction opposite to the rotation, to imparted to the motor element 10, about the axis 2*a* by the fluid-operated reloading cylinder 14.

Advantageously, means for adjusting the preloading of the helical spring 23 are provided. Such adjustment means are constituted by a threaded rod 24, which is connected to the end of the helical spring 23 that is opposite the end connected to the motor element 10. The threaded rod 24 engages a block 34, which is jointly connected to the supporting structure 3, by means of a nut 26 and a lock nut 27, by acting on which it is possible to produce the translational motion of the threaded rod 24 along its own axis in relation to the supporting structure 3, in order to shorten or lengthen the helical spring 23. It is possible to provide, proximate to the threaded rod 24, a graduated scale 25, which is jointly connected to the supporting structure 3 and by means of which it is possible to detect the position of the end of the threaded rod 24 that is opposite the end connected to the helical spring 23, so as to allow high precision in adjusting the preload applied to the helical spring 23.

Preferably, the distance of the direction along which the helical spring 23 is arranged and the main axis 2*a* also can vary so as to vary, with equal elastic reaction or driving force FM generated by the helical spring 23, the driving torque CM applied by said helical spring 23 to the motor element 10. More particularly, the end of the helical spring 23 opposite the threaded rod 24 is connected to the arm 17*b* and along said arm 17*b*, in a radial direction with respect to the main axis 2*a*, there are a plurality of pins 28, which are arranged at different distances from the main axis 2*a* and to which the end of the helical spring 23 can be attached so as to allow, depending on the requirements, adjustment of the arm with which the driving force FM or elastic reaction of the helical spring 23 acts on the motor element 10, generating a driving torque CM which is oriented along the first direction of rotation 41, i.e., opposite to the reloading torque CR generated by the fluid-operated reloading cylinder 14.

Conveniently, the device according to the invention comprises means for delimiting the arc of the rotation of the motor element 10 about the main axis 2*a*. Such means for delimiting the arc of the rotation of the motor element 10 about the main axis 2*a* comprise stroke limiting sensors 29*a*, 29*b*, which are adapted to switch the actuation of the fluid-operated reloading cylinder 14 at least upon the completion of the arc of rotation of the motor element in the second direction of rotation 42.

More particularly, the stroke limiting sensors 29*a*, 29*b* are connected to an element 30 for controlling the supply of the fluid-operated reloading cylinder 14 with a pressurized fluid and on the motor element 10 there are abutments 31*a*, 31*b* which are adapted to interact with the control element 30 when the motor element 10 reaches the ends of its arc of rotation.

Figure 9:
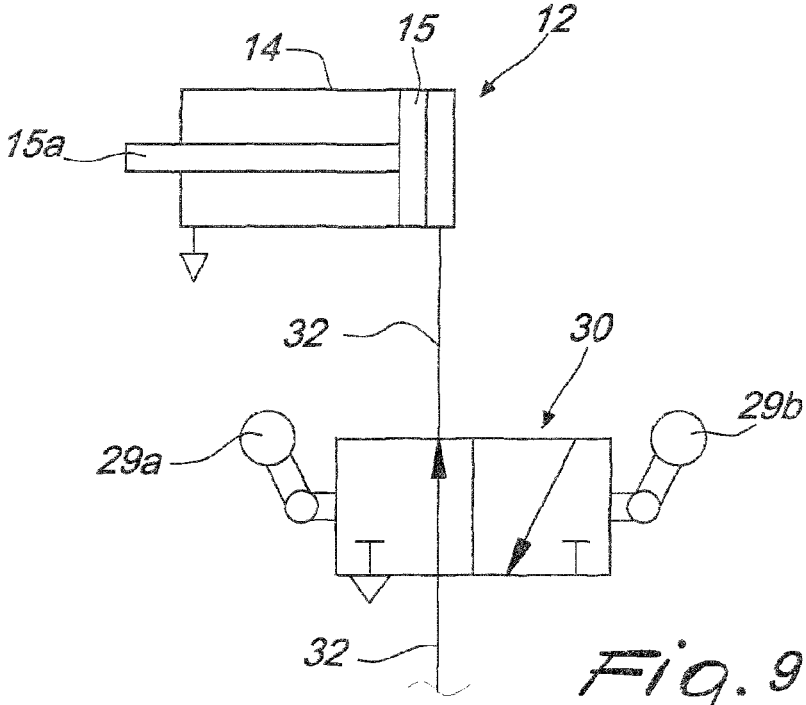
FIGS. 9 and 10 are views of a detail related to the supply of the fluid-operated reloading cylinder in two different operating conditions of is the device.
Figure 10:
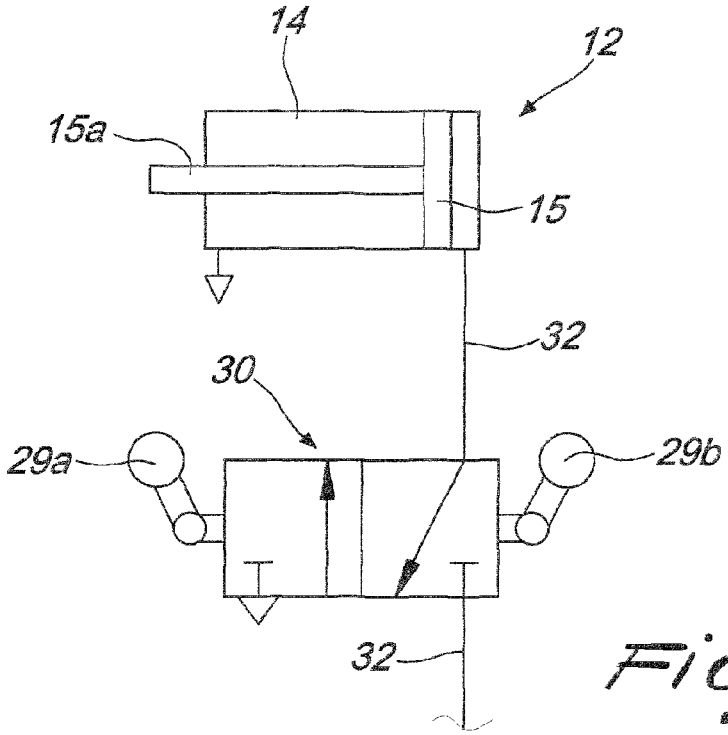

As shown in particular in FIGS. 9 and 10, the control element 30 is constituted by a slide valve of a known type, which is arranged along a supply line 32 of a pressurized fluid and has two operating positions: a first position, shown in FIG. 9, in which it connects the supply line 32 to the fluid-operated reloading cylinder 14 so as to generate the reloading force FR with which the stem 15*a* of said fluid-operated reloading cylinder 14 acts on the control element 30, and a second position, shown in FIG. 10, in which it connects the fluid-operated reloading cylinder 14 to the discharge so as to allow the stem 15*a* of the piston 15 to return by way of the elastic reaction or driving force FM generated by the helical spring 23, as will become better apparent hereinafter. The stroke limiting sensors 29*a*, 29*b* are constituted by the opposite ends of the slide of this valve, and the abutments 31*a*, 31*b* arranged on the motor element 10 operate on said sensors 29*a*, 29*b*.

The abutments 31*a*, 31*b* are constituted by pins, each fitted inside a corresponding curved slot 33*a*, 33*b* provided respectively on the curved portion 18*a* and on the curved portion 18*b* of the control element 30. Each one of the abutments 31*a*, 31*b* is attached to the corresponding curved portion 18*a*, 18*b* for example by bolting, and their position along the corresponding curved slot 33*a*, 33*b* can be changed so as to vary the breadth of the arc of rotation of the motor element 10 about the main axis 2*a*.

According to a constructive variation that is not shown for the sake of simplicity, the actuation means, as an alternative to the helical spring 23, can be constituted by a fluid-operated driving cylinder, which is supplied with a pressurized fluid and acts on the motor element 10 in contrast with the fluid-operated reloading cylinder 14, i.e., to cause its rotation about the main axis 2*a* in the first direction of rotation 41. The pressure of the fluid that supplies said fluid-operated driving cylinder is preferably constant during its operation so as to keep the driving torque CM applied to the motor element 10 substantially constant.

Such fluid-operated driving cylinder can be arranged in the same manner as the helical spring 23, i.e., connected with its body to the supporting structure 3 and with the stem of its piston to one of the pins 28.

Moreover, means of a known type for adjusting the supply pressure of this fluid-operated driving cylinder can be provided in order to vary the extent of the driving force FM and therefore of the driving torque CM that is applied by said fluid-operated driving cylinder to the motor element 10.

This makes it possible to adjust with extreme precision the driving torque CM applied to the motor element 10.

Conveniently, the means for adjusting the pressure of the fluid-operated driving cylinder can be connected to an actuation and control element of the programmable electronic type for varying the supply pressure of the fluid-operated driving cylinder according to a preset program.

Such actuation and control element of the programmable electronic type can be constituted by the actuation and control element that supervises the operation of the circular knitting machine. In this case, the actuation and control element can vary continuously the supply pressure of the fluid-operated driving cylinder as a function of the knitting being performed on the machine, according to preset programs, so as to adjust the takedown force FT, applied to the article 4, to the knitting in progress, thus achieving a high quality in production.

The fluid-operated driving cylinder also is preferably constituted by a pneumatic cylinder.

Optionally, the fluid-operated driving cylinder and the fluid-operated reloading cylinder 14 can be integrated in a single double-acting fluid-operated cylinder which, when supplied in one direction, causes the rotation of the motor element 10 about the main axis 2*a* in the first direction of rotation 41 and when supplied in the opposite direction causes the rotation of the motor element 10 about the axis 2*a* in the second direction of rotation 42.

The supporting structure 3 preferably hangs, for example by means of two suspension arms 35*a*, 35*b*, below the needle cylinder of the circular knitting machine to which the device according to the invention is applied.

Operation of the device according to the invention is as follows.

Figure 6:
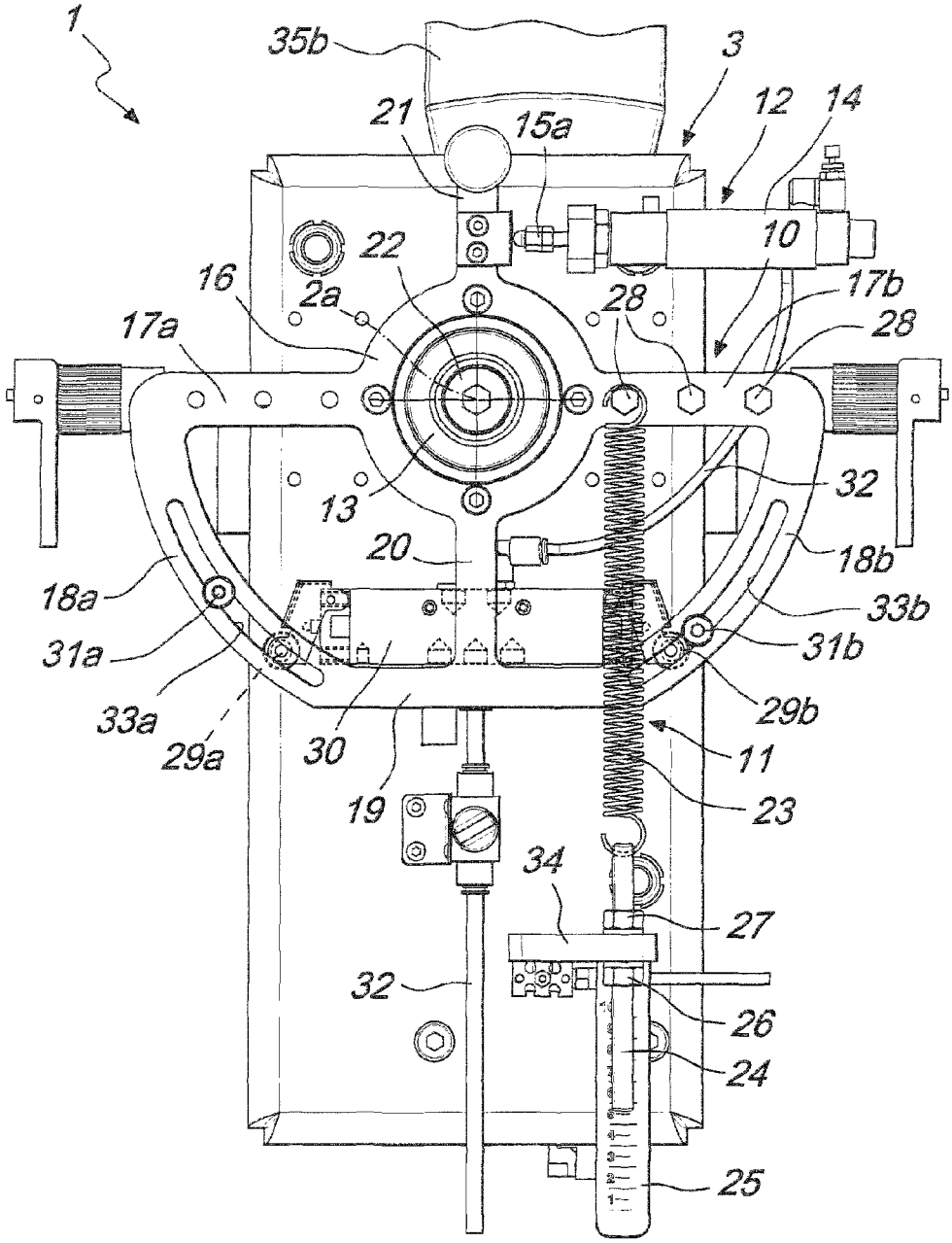
FIG. 6 is an enlarged-scale view of a portion of FIG. 1, with the device in a first operating condition.

Starting from the condition shown in FIG. 6, the fluid-operated reloading cylinder 14 is supplied with a pressurized fluid so that the stem 15*a* of its piston 15 protrudes from the body of the cylinder 14 and applies to the motor element 10 a reloading force FR that produces a reloading torque CR higher than the driving torque CM applied by the helical spring 23 to said motor element 10. As a consequence of the action of the fluid-operated reloading cylinder 14, the motor element 10 rotates about the main axis 2*a* in the second direction of rotation 42, which is counterclockwise in FIGS. 6, 7 and 8, and the presence of the freewheel mechanism 13 prevents said rotation from being transmitted to the takedown roller 2. Moreover, the presence of the other freewheel mechanism 45 prevents the takedown applied to the article 4 from causing, in this step, the rotation of the takedown roller in the direction opposite to the takedown direction, i.e., in the second direction of rotation 42. In this operating condition, the control element 30 is in the position shown in FIG. 9 so as to connect the supply line 32 of a pressurized fluid to the fluid-operated reloading cylinder 14.

Figure 7:
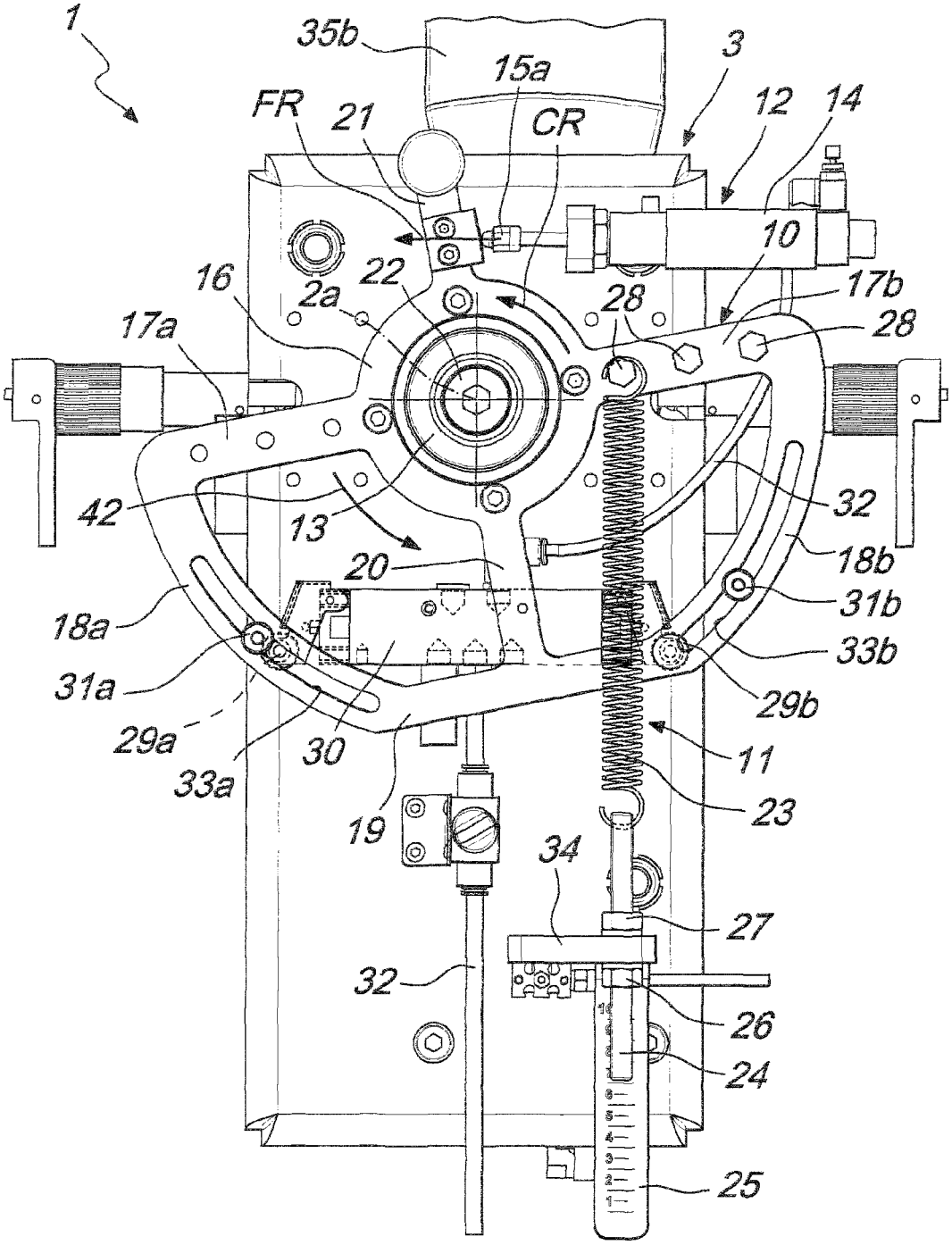
FIG. 7 is a view of the device according to the invention, similar to FIG. 6, in a second operating condition.

The rotation of the motor element 10 about the main axis 2*a* in the second direction of rotation 42 causes the stretching and therefore the loading of the helical spring 23, as shown in FIG. 7.

Figure 8:
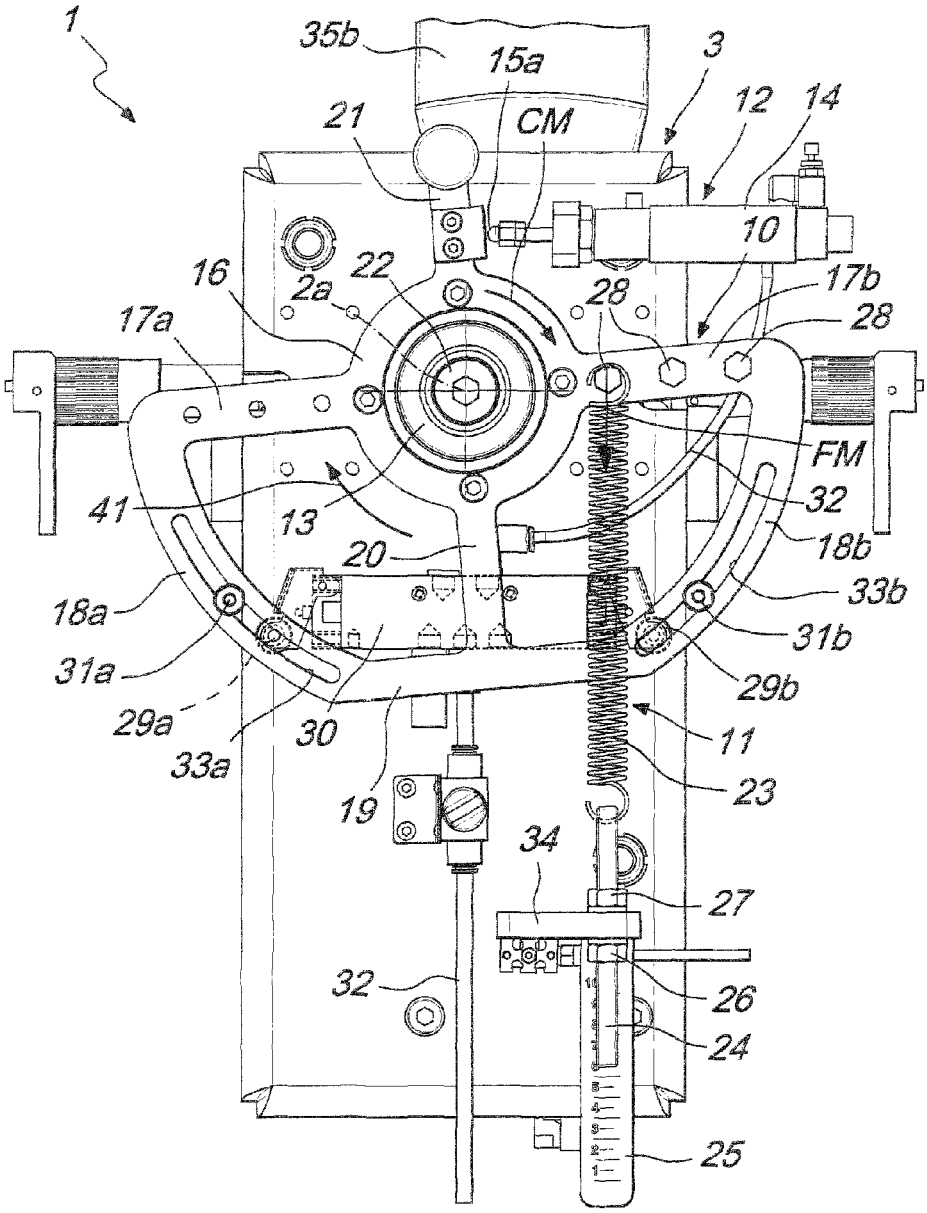
FIG. 8 is a view of the device according to the invention, similar to FIGS. 6 and 7, in a third operating condition.

The rotation of the motor element 10 about the main axis 2*a* in the second direction of rotation 42 continues until the abutment 31*a* makes contact with the sensor 29*a*, switching the slide valve that constitutes the control element 30. Because of such switching, the slide valve shifts to the position shown in FIG. 10, in which it connects the fluid-operated reloading cylinder 14 to the discharge. Due to this switching, the reloading torque CR caused by the reloading force FR generated by the fluid-operated reloading cylinder 14 is no longer present, and therefore the elastic reaction or driving force FM of the helical spring 23, as shown in FIG. 8, causes the rotation of the motor element 10 about the main axis 2*a* in the first direction of rotation 41, i.e., clockwise in FIGS. 6, 7 and 8.

The rotation of the motor element 10 in the first direction of rotation 41, which is caused by the elastic reaction or driving force FM of the helical spring 23, as a consequence of the presence of the freewheel mechanism 13, is transmitted to the takedown roller 2, and the driving torque CM generated by the elastic reaction or driving force FM of the helical spring 23 is converted into a takedown force FT on the article 4 being formed.

The rotation of the motor element 10 about the main axis 2*a* in the first direction of rotation 41 continues until the abutment 31*b* makes contact with the sensor 29*b*, once again causing the switching of the slide valve that constitutes the control element 30, as shown in FIG. 6.

As a consequence of the switching, the fluid-operated reloading cylinder 14 is again supplied with a pressurized fluid and therefore the fluid-operated reloading cylinder 14 operates again on the motor element 10, causing its rotation about the main axis 2*a* in the second direction of rotation 42, i.e., counterclockwise, in FIGS. 6, 7 and 8, loading again the helical spring 23, as shown in FIG. 7.

It should be noted that by maintaining an adequately small arc of rotation of the motor element 10 about the main axis 2*a* there are small variations both of the elastic reaction or driving force FM generated by the helical spring 23 and of the arm that said force FM has with respect to the main axis 2*a*, and therefore it is possible to apply to the takedown roller 2 a substantially constant torque, which leads to a takedown of the article 4 with a force FT that is substantially constant.

If, as an alternative to the helical spring 23, a fluid-operated driving cylinder is used, as described above, the rotation in the first direction of rotation 41, i.e., clockwise, in FIGS. 6, 7 and 8, is produced by the actuation of said fluid-operated driving cylinder. By maintaining a substantially constant pressure for the pressurized fluid that supplies the fluid-operated driving cylinder during the action thereof, it is possible to apply to the motor element 10 a substantially constant driving torque CM that leads to a substantially constant takedown force FT for the article 4. Moreover, in this case, as explained, it is possible to adjust the supply pressure of the fluid-operated driving cylinder and therefore vary the takedown force FT that is applied to the article 4 being formed, even according to preset programs in the machine itself, in order to adapt it to the different operating requirements, achieving a high quality of production.

In practice it has been found that the device according to the invention fully achieves the intended aim, since its structural simplicity makes it possible to contain its weight even in case it is designed to be fitted to medium- or large-diameter circular knitting machines, and is highly reliable and versatile in operation. In particular, because it can actuate the takedown of an article in a circular knitting machine without using the rotation of the needle cylinder, it makes it possible to adjust the tension applied to the article during its formation with higher precision and operating freedom.

Another advantage of the device according to the invention is that it is simple in structure and has a low total weight, which makes it possible to attach its supporting structure directly below the needle cylinder of the machine without the need for further supports for the takedown device.

The device thus conceived is susceptible of numerous modifications and variations, all of which are within the scope of the appended claims; moreover, all the details may be replaced with other technically equivalent elements.

In practice, the materials used, as well as the dimensions, may be any according to requirements and to the state of the art.

The disclosures in Italian Patent Application No. MI2009A000995 from which this application claims priority are incorporated herein by reference.

The invention claimed is:

1. A device for takedown of the article being formed, for circular knitting machines, comprising:

at least one takedown roller, which is supported, so that it can rotate about its own axis, by a supporting structure and can engage, by means of its lateral surface, the article to be taken down;

a motor element that can rotate with a reciprocating motion, along an arc of rotation, about a main axis;

actuation means, which operate on said motor element for its rotation about said main axis in a first direction of rotation;

reloading means that operate on said motor element for its rotation about said main axis in a second direction of rotation that is opposite to said first direction of rotation;

unidirectional connection means interposed between said motor element and said takedown roller for connecting said takedown roller to said motor element in its rotation in said first direction of rotation and for disconnecting said takedown roller from said motor element in its rotation in said second direction of rotation;

characterized in that said reloading means comprise a fluid-operated reloading cylinder, which is supported by said supporting structure and operates with the stem of its piston on said motor element with a reloading force that is oriented along a direction spaced from said main axis for applying to said motor element a reloading torque that is oriented concordantly with said second direction of rotation.

2. The device according to claim 1, wherein said unidirectional connection means are constituted by a freewheel mechanism that is interposed between said motor element and said takedown roller.

3. The device according to claim 1, wherein the axis of said takedown roller is arranged horizontally and coincides with said main axis.

4. The device according to claim 1, further comprising means for delimiting the arc of the rotation of said motor element about said main axis.

5. The device according to claim 4, wherein said means for delimiting the rotation arc comprise stroke limiting sensors, which are adapted to switch the actuation of said fluid-operated reloading cylinder at least upon completion of the arc of rotation of said motor element in said second direction of rotation.

6. The device according to claim 5, wherein said stroke limiting sensors are connected to an element for controlling the supply of said fluid-operated reloading cylinder with a pressurized fluid; abutments being provided on said motor element which are adapted to interact with said stroke limiting sensors when said motor element reaches the ends of its arc of rotation.

7. The device according to claim 6, wherein the position of said abutments on said motor element can vary for varying the breadth of the arc of rotation of said motor element about said main axis.

8. The device according to claim 1, further comprising means for the unidirectional rotation of said takedown roller which are adapted to block the rotation of said takedown roller about its own axis in the direction opposite to the takedown direction of the article.

9. The device according to claim 8, wherein said unidirectional rotation means are constituted by another freewheel mechanism that is interposed between said takedown roller and said supporting structure.

10. The device according to claim 1, wherein said actuation means comprise elastic means that contrast the rotation of said motor element by way of the action of said reloading means.

11. The device according to claim 10, wherein said elastic means comprise a helical spring, which is connected by means of one of its ends to said motor element and by means of its other end to said supporting structure; said helical spring being arranged along a direction that is spaced from said main axis for applying to said motor element a driving torque that is oriented concordantly with said first direction of rotation.

12. The device according to claim 11, further comprising means for adjusting the preload of said helical spring.

13. The device according to claim 11, wherein the distance of the direction along which said helical spring is arranged and of said main axis can vary for varying, with an equal elastic reaction generated by said helical spring, the driving torque applied by said helical spring to said motor element.

14. The device according to claim 1, wherein said actuation means comprise a fluid-operated driving cylinder that operates on said motor element in contrast with said fluid-operated reloading cylinder.

15. The device according to claim 14, wherein said fluid-operated driving cylinder is supplied with a fluid at a substantially constant pressure.

16. The device according to claim 14, further comprising means for adjusting the supply pressure of said fluid-operated driving cylinder.

17. The device according to claim 16, wherein said means for adjusting the pressure of said fluid-operated driving cylinder are connected to an actuation and control element of the programmable electronic type for varying the supply pressure of said fluid-operated driving cylinder according to a preset program.

18. The device according to claim 16, wherein said means for adjusting the pressure of said fluid-operated driving cylinder are connected to an actuation and control element of the programmable electronic type that supervises the operation of the circular knitting machine, said actuation and control element being adapted to vary the supply pressure of said fluid-operated driving cylinder as a function of the knitting being performed on the machine.

19. The device according to claim 14, wherein said fluid-operated driving cylinder and said fluid-operated reloading cylinder are integrated in a single double-acting fluid-operated cylinder.

20. The device according to claim 14, wherein said fluid-operated reloading cylinder and said fluid-operated driving cylinder are pneumatic cylinders.

21. The device according to claim 1, wherein said supporting structure hangs below the needle cylinder of the knitting machine.

* * * * *